US012661564B2

(12) United States Patent
Kapheim

(10) Patent No.: US 12,661,564 B2
(45) Date of Patent: Jun. 23, 2026

(54) PADDLE HEAD GUARD SYSTEM

(71) Applicant: Wilson Sporting Goods Co., Chicago, IL (US)

(72) Inventor: Robert T. Kapheim, Downers Grove, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 876 days.

(21) Appl. No.: 17/884,762

(22) Filed: Aug. 10, 2022

(65) Prior Publication Data

US 2024/0050822 A1 Feb. 15, 2024

(51) Int. Cl.

| | |
|---|---|
| ***A63B 59/00*** | (2015.01) |
| ***A63B 49/14*** | (2015.01) |
| ***A63B 59/42*** | (2015.01) |
| *A63B 102/08* | (2015.01) |
| *A63B 102/16* | (2015.01) |

(52) U.S. Cl.

CPC ..... *A63B 59/42* (2015.10); *A63B 49/14* (2013.01); *A63B 2102/08* (2015.10); *A63B 2102/16* (2015.10); *A63B 2209/10* (2013.01)

(58) Field of Classification Search

CPC . A63B 59/42; A63B 2102/08; A63B 2102/16; A63B 2209/10; A63B 49/14; A63B 2209/00; B63H 16/04

USPC ..... 473/461–464, 521–557

See application file for complete search history.

(56) References Cited

U.S. PATENT DOCUMENTS

| | | | | |
|---|---|---|---|---|
| 1,630,683 A * | 5/1927 | Williamson | ..... | A63B 49/02 473/546 |
| 2,309,476 A | 1/1943 | Patterson, Jr. | | |
| 3,557,156 A | 1/1971 | Enneper et al. | | |
| 3,890,649 A | 6/1975 | Diggins | | |
| 3,900,024 A | 8/1975 | Lauber et al. | | |
| 3,923,049 A | 12/1975 | Lauber et al. | | |
| 3,930,920 A * | 1/1976 | Kicherer | ..... | A63B 60/00 156/194 |
| 4,051,553 A | 10/1977 | Howard | | |
| 4,061,106 A * | 12/1977 | Ware | ..... | B63H 16/04 416/74 |
| 4,130,277 A * | 12/1978 | Marks | ..... | A63B 60/08 473/527 |

(Continued)

FOREIGN PATENT DOCUMENTS

| | | | | |
|---|---|---|---|---|
| CN | 102458839 A * | 5/2012 | ..... | A63C 11/227 |
| CN | 105773990 A * | 7/2016 | | |

(Continued)

OTHER PUBLICATIONS

RSPRO Water, "RSPro edge saver installation HD", YouTube video, Feb. 17, 2022, https://www.youtube.com/watch?v=f-5BiS81gqQ, retrieved from the internet on Jan. 12, 2024, the whole video and related description.

(Continued)

*Primary Examiner* — Kiley S Stoner

(74) *Attorney, Agent, or Firm* — Terence P. O'Brien; Todd A. Rathe

(57) ABSTRACT

A paddle head guard system may include a paddle head guard sized to at least partially cover an outer edge portion of a paddle head. The guard may include a moldable and hardenable band configured to be hardened after being wrapped over the outer edge portion of the paddle head.

21 Claims, 6 Drawing Sheets

(56) References Cited

U.S. PATENT DOCUMENTS 4,235,228 A 11/1980 Gaylord et al.
4,279,344 A 7/1981 Holloway, Jr.
4,295,229 A 10/1981 Clark et al.
4,301,564 A 11/1981 Dalebout
4,393,024 A * 7/1983 You ..... A63B 49/10 264/339
4,400,829 A 8/1983 Willis
4,411,262 A 10/1983 von Bonin et al.
4,427,002 A 1/1984 Baron et al.
4,428,089 A 1/1984 Dawber et al.
4,433,494 A 2/1984 Courvoisier et al.
4,433,680 A 2/1984 Yoon
4,442,833 A 4/1984 Dahlen et al.
4,484,360 A 11/1984 Leighton et al.
4,502,479 A 3/1985 Garwood et al.
4,559,646 A 12/1985 Ertl
4,570,622 A 2/1986 von Bonin et al.
4,572,171 A 2/1986 Wegner et al.
4,598,429 A 7/1986 Mulvaney
4,676,861 A 6/1987 Bishop
4,690,932 A 9/1987 Mulvaney
4,701,963 A 10/1987 Overton
4,770,299 A 9/1988 Parker
4,832,010 A 5/1989 Lerman
4,837,884 A 6/1989 Hilgarth
4,843,651 A 7/1989 Gramza et al.
4,864,660 A 9/1989 Sawyer
4,869,046 A 9/1989 Parker
4,964,229 A 10/1990 Laberge
4,966,134 A 10/1990 Brewer
5,003,970 A 4/1991 Parker et al.
5,027,803 A 7/1991 Scholz et al.
5,117,509 A 6/1992 Bowers
D327,754 S 7/1992 Hochgesang et al.
5,183,263 A 2/1993 Kuebler
5,295,269 A 3/1994 Ballard
5,316,294 A 5/1994 Turangan
5,335,916 A 8/1994 Nee
5,364,580 A 11/1994 Prent
5,425,701 A 6/1995 Oster et al.
5,480,376 A 1/1996 Duback et al.
5,511,248 A 4/1996 Widdemer
5,517,694 A 5/1996 Fabry
5,537,692 A 7/1996 Dorr
5,544,663 A 8/1996 Duback
5,598,582 A 2/1997 Andrews et al.
5,608,912 A 3/1997 Cumberland
5,636,381 A 6/1997 Brogden
5,637,077 A 6/1997 Parker
5,665,056 A 9/1997 Nakasugi et al.
5,692,242 A 12/1997 Tekerman et al.
5,708,979 A 1/1998 Redwood et al.
5,727,257 A 3/1998 Chen
5,732,713 A 3/1998 Duback et al.
5,745,919 A 5/1998 Kraatz
5,755,678 A 5/1998 Parker et al.
5,802,614 A 9/1998 Melone, Jr.
5,806,091 A 9/1998 McHugh
5,833,637 A 11/1998 Pong
5,867,830 A 2/1999 Chen
5,957,871 A 9/1999 Darcey
5,980,474 A 11/1999 Darcey
6,006,358 A 12/1999 Keating
6,022,331 A 2/2000 Darcey
6,044,494 A 4/2000 Kang
6,049,910 A 4/2000 McCarter
6,052,827 A 4/2000 Widdemer
6,065,155 A 5/2000 Sandusky
6,105,162 A 8/2000 Douglas
6,128,777 A 10/2000 Foreman
6,182,293 B1 2/2001 Mustin
6,185,747 B1 2/2001 Hughes
6,223,353 B1 5/2001 Lardieri, Jr.
6,253,382 B1 7/2001 Kleinert
6,408,442 B1 6/2002 Kang
6,457,181 B1 10/2002 Grundy
6,526,593 B2 3/2003 Sajovic
6,539,550 B1 4/2003 Flores
6,745,402 B2 6/2004 Caswell
6,745,403 B2 6/2004 Sajovic
6,912,731 B2 7/2005 Cass
6,964,063 B2 11/2005 Bamber
7,210,172 B2 5/2007 Adams, Jr.
7,293,296 B1 11/2007 Beraznik et al.
7,487,553 B2 2/2009 Price
7,669,251 B2 3/2010 Hammons et al.
7,966,670 B2 6/2011 Wilbert et al.
8,191,174 B2 6/2012 Winningham et al.
8,225,426 B2 7/2012 Bevier
8,225,427 B2 7/2012 Bevier
8,239,969 B2 8/2012 Fisher
8,241,705 B2 8/2012 Sha
8,256,028 B1 9/2012 Ibon et al.
8,266,719 B2 9/2012 Duby
9,198,474 B1 12/2015 Hacobian
10,004,975 B2 6/2018 Clement
11,058,940 B2 7/2021 Gilday et al.
D1,003,527 S * 10/2023 Boyd ..... A63B 71/10 D29/122
2003/0037364 A1 2/2003 Alber
2004/0025226 A1 2/2004 Jaeger
2004/0045074 A1 3/2004 Tremblay
2004/0060097 A1 4/2004 Bamber
2004/0068777 A1 4/2004 Wheelington, II
2004/0107476 A1 6/2004 Goldwitz
2005/0034213 A1 2/2005 Bamber
2006/0258474 A1* 11/2006 Gruenke ..... A63B 69/36 473/226
2007/0174948 A1 8/2007 Robba
2007/0209097 A1 9/2007 Iacullo
2008/0010719 A1 1/2008 Hoelscher
2008/0229477 A1 9/2008 McGrough
2008/0271224 A1 11/2008 Wilbert et al.
2009/0077706 A1 3/2009 Prather
2009/0139007 A1 6/2009 Bevier
2009/0139010 A1 6/2009 Bevier
2010/0024095 A1 2/2010 Gellis
2010/0077526 A1 4/2010 Smeltzer
2010/0077532 A1 4/2010 Kettani
2010/0077533 A1 4/2010 Munda
2010/0095428 A1 4/2010 Fisher
2010/0186140 A1 7/2010 Ramirez
2010/0325777 A1 12/2010 Radakrishnan et al.
2011/0041235 A1 2/2011 Harris
2011/0113521 A1 5/2011 Bradford
2011/0214220 A1 9/2011 Parker
2011/0214221 A1 9/2011 Munda
2011/0258754 A1 10/2011 DuPont
2011/0287876 A1* 11/2011 DeMasi ..... A63B 60/00 473/532
2011/0296582 A1 12/2011 Bevier et al.
2012/0005580 A1 1/2012 Bevier et al.
2012/0011633 A1 1/2012 Van Hale
2012/0028738 A1 2/2012 Love
2012/0030855 A1 2/2012 Clark
2012/0030856 A1 2/2012 Bevier
2012/0042438 A1 2/2012 Ramirez
2012/0073029 A1 3/2012 Clark
2012/0159681 A1 6/2012 Gibby
2012/0204319 A1 8/2012 Gambordella
2012/0227155 A1 9/2012 Brown
2012/0227158 A1 9/2012 Ashworth et al.
2012/0245503 A1 9/2012 DeVries
2012/0324623 A1 12/2012 Cabauy et al.
2013/0036523 A1 2/2013 Webster
2013/0061369 A1 3/2013 Lim
2013/0167281 A1 7/2013 Jennings
2013/0198920 A1 8/2013 Wittman
2013/0227755 A1 9/2013 Bisaillon
2013/0239291 A1 9/2013 Harris
2013/0283498 A1 10/2013 Hewitt
2015/0165302 A1 6/2015 Jaramillo et al.
2015/0314189 A1 11/2015 Le
2016/0367881 A1 12/2016 Le

(56) References Cited

U.S. PATENT DOCUMENTS

| | | | | |
|---|---|---|---|---|
| 2017/0282048 | A1 | 10/2017 | Wittman | |
| 2018/0104555 | A1* | 4/2018 | Taylor | A63B 59/45 |
| 2018/0193718 | A1 | 7/2018 | Gilday et al. | |
| 2018/0255849 | A1 | 9/2018 | Paquette et al. | |
| 2019/0002617 | A1* | 1/2019 | Kotani | C09J 7/385 |
| 2020/0405320 | A1 | 12/2020 | Kawamoto | |
| 2021/0007873 | A1 | 1/2021 | Frederick | |
| 2021/0052968 | A1 | 2/2021 | Ciaglia | |
| 2021/0378332 | A1* | 12/2021 | Tryner | A41F 1/06 |
| 2022/0088464 | A1 | 3/2022 | Kawiya | |
| 2022/0212087 | A1 | 7/2022 | Kucharsky | |
| 2023/0127294 | A1* | 4/2023 | Otto | A42B 1/019 2/181 |
| 2023/0337762 | A1* | 10/2023 | Otto | A41D 13/084 |
| 2024/0050822 | A1* | 2/2024 | Kapheim | A63B 59/42 |

FOREIGN PATENT DOCUMENTS

| | | | | |
|---|---|---|---|---|
| CN | 217067583 | | 7/2022 | |
| EP | 2575016 | A2 * | 4/2013 | G06F 3/044 |
| GB | 2055582 | | 3/1981 | |
| GB | 2200286 | | 8/1988 | |
| JP | 2018100457 | A * | 6/2018 | |
| KR | 101417876 | B1 * | 7/2014 | |
| KR | 20190121428 | A * | 10/2019 | |
| TW | M271022 | U * | 7/2005 | |
| TW | M299165 | U * | 10/2006 | |
| TW | M315226 | U * | 7/2007 | |
| WO | 2009142796 | | 11/2009 | |

OTHER PUBLICATIONS

Blueplanetsurf, "SUP Paddle Edge Guard application", Youtube video, Jul. 21, 2012, https://www.youtube.com/watch?v=6eCwNQVh6m4, retrieved on Jan. 12, 2024, the whole video and related description.

Anonymous, "Scratches and nicks protection for the edge of your carbon paddle blade.", Noordzee Boardstore, webshop, Apr. 1, 2018, pp. 1-6, https://noordzeeboardstore.nl/product/edge-saver-jumbo/, the whole document.

* cited by examiner

PADDLE HEAD GUARD SYSTEM

BACKGROUND

Paddles are used in a variety of sports to strike a projectile. Such paddles comprise a handle supporting a head. The head has an outer edge surrounding a hitting area of the paddle. The outer edge may be subject to wear and damage when the outer edge of the head contacts a playing surface or the ground during play.

BRIEF DESCRIPTION OF THE DRAWINGS

Throughout the drawings, identical reference numbers designate similar, but not necessarily identical, elements.

Figure 1:
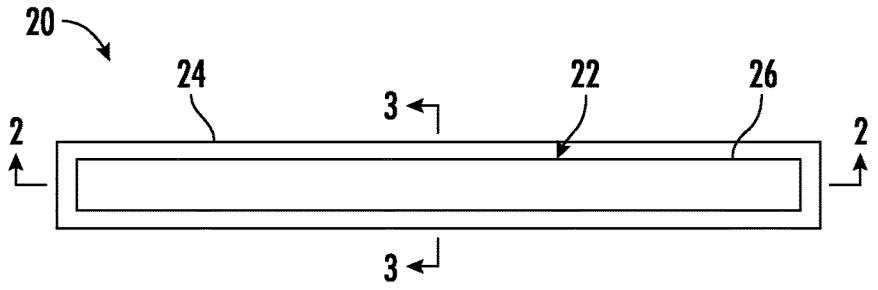
FIG. 1 is a top view of an example paddle head guard system illustrating an example head guard contained in an example airtight package which is transparently shown for purposes of illustration.

The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION OF EXAMPLES

Disclosed are example paddle head guard systems or kits that protect the outer edge, especially the distal outer edges, of the head of a paddle from wear and damage during play. The example paddle head guard systems comprise head guards that are lightweight and thin. The example head guards include moldable and hardenable bands that may be moldable about portions of the paddle head, permitting the head guards to be adapted to differently sized and differently shaped existing paddle heads. The example bands, once molded or shaped to a particular shape of a particular paddle head, naturally harden, to form a durable outer shell along the perimeter or outer edge of the paddle head.

The disclosed example paddle head guard systems comprise an example paddle head guard having a moldable and hardenable band that is sized to cover a top/distal and/or outer edge portion of a paddle head. The paddle head may comprise a perforate or imperforate panel for striking a projectile, such as a ball. The paddle head may omit stringing. The paddle may be in the form of a paddle used for paddle tennis (Padel), platform tennis, pickle ball, table tennis or the like.

In some implementations, the moldable and hardenable band of the head guard is formed from a layer of material having composition that is hardenable to a hardness or durometer value of at least 70 on a Shore A scale in response to being removed from the airtight package. In one implementation, the band can have a weight of less than 20 grams, a width of 50 mm or less, a thickness of 4 mm or less, and a length of 400 mm or less. In another implementation, the band can have a weight of no greater than 13 g, a width of no greater than 45 mm, a thickness of 3 mm or less (and in some implementations, no greater than 2 mm), and/or a length of no greater than 350 mm. In other implementations, the band of the guard may have other dimensions depending upon the particular dimensions of the distal edge or outer edge of the head of the particular paddle.

In some implementations, the moldable and hardenable band of the head guard is formed from a material having a composition that is activated to a soft moldable state in response to the application of heat to the band. For example, in some implementations, the band may be placed in boiling water or placed in a microwave, wherein the application of heat to the band because the band to soften to a moldable state. While in the heated and moldable state, the band may be wrapped or molded about or against the outer edge portion of a paddle head. The temperature of the heated band, when in the moldable state, is greater than ambient room temperature, but less than a temperature that will melt or otherwise damage the head of the paddle. Upon cooling of the band, from the elevated temperature resulting from the application of the heat, the band hardens. In some implementations, the band, upon cooling, hardens to a hardness or durometer value of at least 70 on a Shore A scale in response to being removed from the airtight package. In one implementation, the band can have a weight of less than 20 grams, a width of 50 mm or less, a thickness of 4 mm or less, and a length of 400 mm or less. In another implementation, the band can have a weight of no greater than 13 g, a width of no greater than 45 mm, a thickness of 3 mm or less, and/or a length of no greater than 350 mm.

In some implementations, the guard may consist solely of the moldable and hardenable band. In some implementations, the guard may comprise additional layers on either face of the moldable and hardenable band. The additional layers may comprise adhesive layers, manually peelable films, and/or additional cushion layers such as foams or the like. The adhesive layers may serve to assist in securing and retaining the moldable and hardenable band to the outer peripheral edge of the paddle head. The films may assist in covering and protecting the adhesive layer until ready for use. The cushion layers may be adhered, directly or indirectly, to the moldable and hardenable band and provide lightweight cushion, wherein the moldable and hardenable band, once hardened, retains the cushion layers in the shape of the paddle head edge.

In some implementations, the moldable and hardenable band of the guard has a flat profile. In some implementations, the moldable and hardenable band of the guard may have a flat profile on one face and a rounded, curved or polygonal profile on an opposite face. In some implementations, the moldable and hardenable band of the guard may have a first face provided with a non-flat shape for mating with a groove or other surface shape of the paddle outer edge. In some implementations, the moldable and hardenable band of the guard may have an outer face that is opposite to the face, which is to extend adjacent the outer paddle edge, wherein the outer face has a non-flat shape. For example, in some implementations, the outer face of the moldable and hardenable band of the guard may have a three-dimensional surface design or logo.

In some implementations, the moldable and hardenable band of the guard is imperforate. In some implementations, the moldable and hardenable band of the guard is perforated, including an opening or multiple openings therethrough. Such openings may reduce the overall weight of the paddle head guard system. Such openings may provide a decorative appearance for the paddle head guard system.

In some implementations, the moldable and hardenable band of the guard has a uniform thickness and a uniform weight density along both its length and its width. In some implementations, the moldable and hardenable band of the guard may have a non-uniform thickness and/or a non-uniform weight density along its length and/or along its width to provide a customized weight distribution for a particular player using the paddle. In some implementations, the moldable and hardenable band of the guard may encapsulate or may be joined to individual weight elements.

The band or strip of the paddle head guard comprises at least one layer of a moldable and hardenable material such that the band may be molded or shaped about portions of the paddle head, permitting the paddle head guard system to be adapted to differently sized and differently shaped existing paddle heads. The band, once molded or shaped to a particular shape of a particular paddle head, may naturally harden, upon simple exposure to air or upon cooling, to form a durable outer shell along the perimeter or outer edge of the paddle head.

In one example implementation, the moldable and hardenable band comprises a GEL-TO-SHELL® material. The GEL-TO-SHELL® material is produced under the EVOSHIELD® trademark by Wilson Sporting Goods Co. The GEL-TO-SHELL® material begins as soft and flexible, but chemical components initiate hardening upon exposure to air (which may be at the same temperature as the band), such as upon removal of the paddle head guard from an airtight enclosure a container, such as a foil bag, or such as upon sufficient bending of such a container so as to break an airtight encasement enclosing the band. In approximately 20 to 30 minutes, the once soft material of the band transforms into hard protective guard permanently molded to a desired shape. The hardening of the band does not occur in response to any cooling of the band, but occurs as a result of a chemical reaction resulting from the exposure to the air. During the 20 to 30 minutes prior to hardening, the material of the band may be shaped and molded about portions of the edge of the paddle head. The GEL TO SHELL® material enables the protective band or guard to be customized to the exact shape of the user's paddle. In other implementations, the material used to form the moldable and hardenable band may comprise other compositions that may be molded about and against paddle outer edge while in a soft flexible state and that may be subsequently hardened to a force dispersing rigid shell upon a triggering event such as exposure to air, exposure to water, exposure to heat and/or upon cooling from an elevated temperature, wherein such exposure is tolerable to the paddle head.

In those implementations in which the guard is for application to pre-existing/aftermarket paddle heads and in which the guard is formed from a moldable and hardenable band of material that undergoes hardening in response to exposure to sufficient quantities of air, the guard may be packaged in an airtight container or package. The airtight package may be in the form of a pair of aluminum, metal or other foils of air impermeable material or materials sealed against one another about the guard. In some implementations, the airtight package contains only a single guard for a single paddle head. In some implementations of the airtight package contains a pair of guards for a pair of paddle heads. Once opened or once the seal of the package is broken, the guards must be applied in shaped particular paddle head rims prior to completion of their hardening.

To facilitate faster application of the guards to the head once the guard or guards are removed from the airtight package, the guards may be precut and pre-sized for a particular paddle head or paddle head edge. In some implementations, the guards may include markings or indicia indicating or outlining a recommended cut or severing line for particular paddle head sizes, permitting a person to quickly cut and downsize the guard or band for a particular paddle head size once the guard has been removed from the airtight package. In other implementations, the markings or indicia can include one or more trademarks, or one or more alphanumeric and/or graphical designs. For example, the guard contained within the airtight package may have a width greater than the width of a particular paddle head to which the guard is to be applied. The guard or band may include a series of dashes or broken lines printed or otherwise formed upon the band (or a peel away film secured to the band) based upon the particular paddle head to indicate to a person where to cut the guard for the particular paddle head. In some implementations, guard or band may include a plurality of different recommended cut lines for a plurality of different paddle head sizes. In some implementations, the recommended cut lines may be omitted.

For purposes of this disclosure, the term "airtight" means that the guard is contained in a volume within the package (also referred to as a container) in which the ingress of air into the volume is restricted or limited to an extent such that the guard and its moldable and hardenable band are not exposed to a sufficient quantity of air so as to undergo hardening while sealed within the package. As indicated above, in some implementations, the breaking of the seal of the package and removal of the guard from the sealed package will initiate hardening of the band. However, in such implementations, the hardening process is sufficiently slow (taking approximately 15 to 30 minutes) such that the band is sufficiently shapeable, flexible and moldable immediately upon removal from the package so be wrapped distal portions of the paddle head edge to provide a customized fit to the head of the paddle, wherein the hardening process is completed while the guard is either manually held in its non-flat molded shape against the perimeter of the edge or is adhesively held in his non-flat, curved around and shape against the perimeter of the head.

In some implementations, such molding and subsequent hardening of the moldable and hardenable band of the guard about the distal edge of the paddle head results in the guard locking to and against the distal edge of the paddle head. For example, portions of the guard may be wrapped about wider portions of the edge and bent inwardly prior to hardening of the layer, wherein the opposite side edges of the layer are separated by a distance that is less than the wider with of portions of the head adjacent to the edge.

In some implementations, the moldable and hardenable band of the guard may be adhesively bonded to the outer perimeter of the distal edge of the paddle head prior to hardening of the band. An adhesive layer secured to the inner face of the band may retain the layer in its selected molded shape against and about the distal edge of the paddle as the band undergoes hardening. In some implementations, the band is retained about the distal edge of the paddle head by both the locking of the band about the edge and an adhesive layer. In some implementations, the guard is not shaped so as to be locked about the distal edge of the paddle head but is retained to the distal edge of the paddle head solely by the adhesive.

In some implementations, the adhesive layer is coated or otherwise applied to the inner face of the moldable and hardenable band (the face of the moldable and hardenable band that is to face the outer peripheral edge or surface of the paddle head) prior to sealing of the moldable and hardenable band within the airtight package so as to reside on the inner face of the moldable and hardenable band while the moldable and hardenable band is within the airtight package. In some implementations, the paddle head guard system additionally comprises a film covering the face of the adhesive layer that is not adjacent the moldable and hardenable band, wherein the foil or film is manually peelable from the adhesive layer, permitting the film to be removed and separated from the adhesive layer while the adhesive layer remains adhered to the moldable and hardenable band. The film inhibits the adhesive layer from bonding to the interior surfaces of the airtight package. Upon removal of the guard from the package, the film may be peeled away from the adhesive layer, exposing the adhesive layer for application to the outer edge portions of the paddle.

In some implementations, the adhesive layer may be provided external to the airtight package containing the paddle head guard. In such implementations, the adhesive layer may be supported by film that directly contacts a first face of the adhesive layer. The film may be manually peelable from the adhesive layer while the adhesive layer is bonded to either the guard or the peripheral surfaces of the paddle head rim. In one implementation, the second face of the adhesive layer may be adhered to the guard (after its removal from the airtight package), wherein the film may then be peeled away from the adhesive layer, exposing the first face of the adhesive layer for being adhered to the paddle head edge or peripheral edge. In one implementation, the second face of the adhesive layer may be adhered to the paddle head edge or peripheral edge, wherein the film may then be peeled away from the adhesive layer, exposing the first face of the adhesive layer for being adhered to the band (after its removal from the airtight package). In some implementations, a second film may cover the second face of the layer, wherein the second film is peelable away from the second face of the adhesive layer.

For purposes of this disclosure, the term "coupled" shall mean the joining of two members directly or indirectly to one another. Such joining may be stationary in nature or movable in nature. Such joining may be achieved with the two members, or the two members and any additional intermediate members being integrally formed as a single unitary body with one another or with the two members or the two members and any additional intermediate member being attached to one another. Such joining may be permanent in nature or alternatively may be removable or releasable in nature.

For purposes of this disclosure, the phrase "configured to" denotes an actual state of configuration that fundamentally ties the stated function/use to the physical characteristics of the feature proceeding the phrase "configured to".

Figure 2:
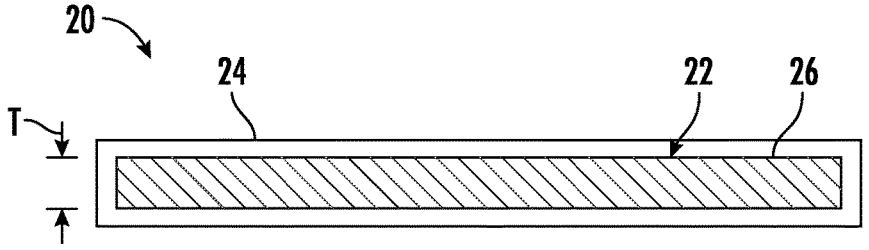
FIG. 2 is a sectional view of the system of FIG. 1 taken along line 2-2.
Figure 3:
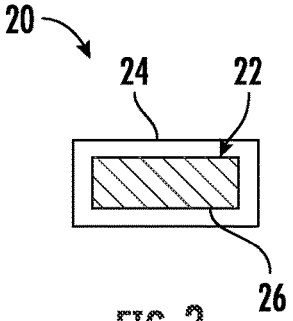
FIG. 3 is a sectional view of the system of FIG. 1 taken along line 3-3.

FIGS. 1-3 illustrate portions of an example paddle head guard system 20. FIG. 1 is a top view of paddle head guard system 20 while FIGS. 2 and 3 are sectional views of paddle head guard system 20. Paddle head guard system 20 is configured (sized and shaped) for application to the head of an existing paddle to protect edge portions of the paddle from impacts during play. Paddle head guard system 20 is moldable about portions of the paddle head, permitting the paddle head guard system to be adapted to differently sized and differently shaped existing paddle heads. Paddle head guard system 20, once molded or shaped to a particular shape of a particular paddle head, naturally hardens, upon simple exposure to air, to form a durable outer shell along the perimeter or outer edge of the paddle head.

Paddle head guard system 20 comprises a paddle head guard that is sized to cover a top/distal outer edge portion of a paddle head. The paddle head may comprise a perforate or imperforate panel for striking a projectile, such as a ball. The paddle head may omit stringing. The paddle may be in the form of a paddle used for paddle tennis (Padel), platform tennis, pickle ball, table tennis or the like.

Paddle head guard system 20 comprises guard 22 and airtight package 24. Guard 22 comprises a moldable and hardenable band 26 comprising a layer or multiple layers of moldable and hardenable material, wherein band 26 sized to at least partially cover an outer edge portion of a paddle head. Band 26 is configured to be hardened after being wrapped over the outer edge portion of the paddle head. In one implementation, band 26 hardens in response to sufficient exposure to air, wherein the hardening is completed in less than one hour following such exposure. To maintain band 26 in a flexible and moldable state prior to use, band 26 is sealed within and airtight package 24. In some implementations, the airtight package 24 contains only a single guard 22 for a single paddle head. In some implementations of the airtight package 24 contains a pair of guards 22 for a pair of paddle heads. Once opened or once the seal of the package 24 is broken, the guard(s) 22 must be applied and shaped to their assigned paddle heads prior to completion of their hardening. Although both band 26 and package 24 are illustrated as being rectangular, in other implementations, band 26 and/or package 24 may have other shapes and relative sizes.

In some implementations, band 26 has a thickness T of no greater than 4.0 mm. In other implementations, the thickness T of the band 26 can be less than 3.0 mm. In still other implementations, the thickness T of the band can be less than 2.0 mm. This thickness allows guard 22 to be lightweight and to be less discernible on the edge of a paddle head. This thickness further facilitates easier bending and wrapping of band 26 about the rounded or curved profile of the edge of the paddle head. However, because band 26 hardens, the relatively thin nature of band 26 does not inhibit or impair its ability to protect the outer edge portion of the paddle head nor does it subject band 26 to accelerated wear. In some implementations, band 26 hardens to a hardness of at least 70 on a Shore A scale. In other implementations, band 26 may have a greater thickness or other degrees of hardness.

In the example illustrated, band 26 is flat, is imperforate, has a uniform width along its length and has a uniform thickness along its length. In the example illustrated, band 26 has a weight of no greater than 13 g and a width of no greater than 45 mm in the example illustrated, band 26 has a length of no greater than 350 mm. These dimensions facilitate the use of band 26 on a large variety of paddle heads, wherein band 26 may not need resizing prior to application to a paddle head. As will be described hereafter, in other implementations, band 26 may be perforated, may have a nonuniform width along its length and/or a nonuniform thickness along its length. Band 26 may have a weight greater than 13 g and a, a width greater than 45 mm and a length greater than 350 mm. In some implementations, band 26 may have a size larger than the edge portions of different paddles, wherein band 26 may be resized source cut, prior to complete hardening, to the desired size for a particular paddle head. In one implementation, the band can have a weight of less than 20 grams, a width of 50 mm or less, a thickness of 4 mm or less, and a length of 400 mm or less. In another implementation, the band can have a weight of no greater than 13 g, a width of no greater than 45 mm, a thickness of 3 mm or less, and a length of no greater than 350 mm. In other implementations, the band of the guard may have other dimensions depending upon the particular dimensions of the distal edge or outer edge of the head of the particular paddle.

In some implementations, band 26 comprises at least one layer of a moldable and hardenable material such that the band may be molded or shaped about portions of the paddle head, permitting the band 26 of paddle head guard system 20 to be adapted to differently sized and differently shaped existing paddle heads. Band 26, once molded or shaped to a particular shape of a particular paddle head, may naturally harden, upon simple exposure to air, to form a durable outer shell along the perimeter or outer edge of the paddle head.

In one example implementation, the moldable and hardenable material of band 26 comprises a GEL-TO-SHELL® material. The GEL-TO-SHELL® material begins soft and flexible, but chemical components initiate hardening upon exposure to air, such as upon removal of the paddle head guard system or the individual moldable band from airtight package 24 or such as upon sufficient bending so as to break the airtight encasement provided by package 24. In approximately 20 to 30 minutes, the once soft material of guard 22 transforms into hard protective guard permanently molded to a desired shape. During the 20 to 30 minutes prior to hardening, the material of guard 22 may be shaped and molded about portions of the edge of the paddle head. In other implementations, the material used to form band 26 of guard 22 may comprise other compositions that may be molded about and against paddle outer edge while in a soft flexible state and that may be subsequently hardened to a force dispersing rigid shell upon a triggering event such as exposure to air, exposure to water and/or exposure to heat, wherein such exposure is tolerable to the paddle head. In implementations does not harden in response to exposure to air or does not completely harden within one hour following exposure to air, package 24 may have other configurations and/or may not necessarily be airtight. In some implementations, package 24 may be omitted.

In some implementations, such molding and subsequent hardening of the band 26 about the distal edge of the paddle head results in the band 26 locking to and against the distal edge of the paddle head. For example, portions of the band 26 may be wrapped about wider portions of the edge and bent inwardly prior to hardening, wherein the opposite side edges of band 26 are separated by a distance that is less than the wider with of portions of the paddle edge.

In some implementations, the moldable and hardenable band 26 of the head guard is formed from a material having a composition that is activated to a soft moldable state in response to the application of heat to the band. For example, in some implementations, the band may be placed in boiling water or placed in a microwave, wherein the application of heat to the band causes the band to soften to a moldable state. While in the heated and moldable state, the band may be wrapped or molded about or against the outer edge portion of a paddle head. The temperature of the heated band, when in the moldable state, is greater than ambient room temperature, but less than a temperature that will melt or otherwise damage the head of the paddle. Upon cooling of the band, from the elevated temperature resulting from the application of the heat, the band hardens. In some implementations, the band, upon cooling, hardens to a hardness of at least 70 on a Shore A scale. In one implementation, the band can have a weight of less than 20 grams, a width of 50 mm or less, a thickness of 4 mm or less (no greater than 2 mm in some implementations), and a length of 400 mm or less. In another implementation, the band can have a weight of no greater than 13 g, a width of no greater than 45 mm, a thickness of 3 mm or less, and/or a length of no greater than 350 mm. In implementations where band 26 is hardenable in response to cooling from an elevated temperature resulting from the application of heat, rather than from mere exposure to air, package 24 need not be airtight or may be omitted.

Figure 4:
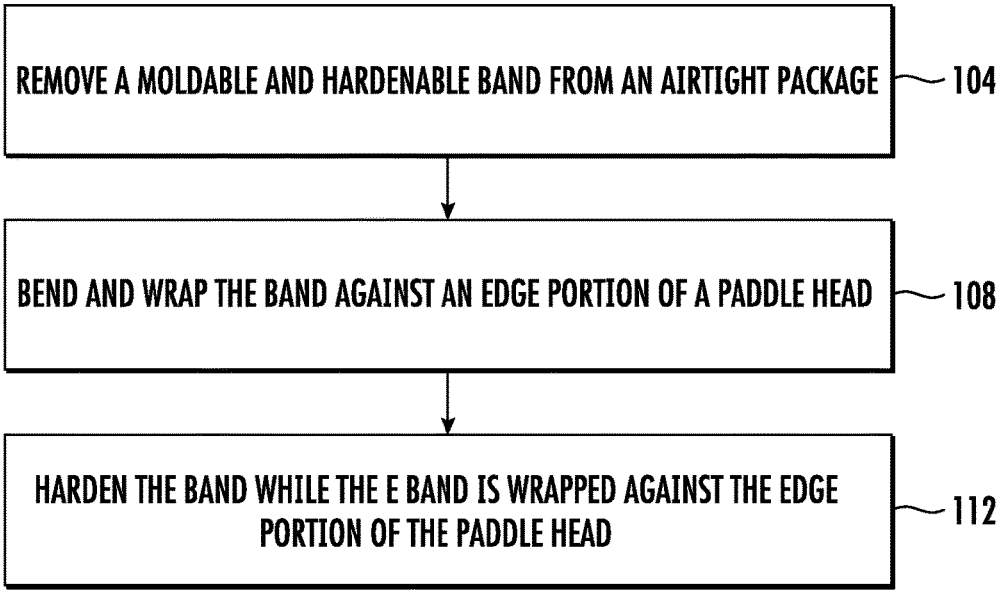
FIG. 4 is a flow diagram of an example method for protecting outer edge portions of a paddle head from damage, abrasion and wear during play.

FIG. 4 is a flow diagram of an example method 100 for protecting outer edge portions of a paddle head from damage, abrasion and wear during play. Method 100 facilitates modifying an existing paddle, an aftermarket paddle, to protect the outer edge portions of the paddle head. Although method 100 is described in the context of using paddle head guard system 20 described above with respect to FIG. 1, method 100 may likewise be carried out with any of the other paddle head guard systems described in this disclosure or with similar paddle head guard systems.

Figure 5:
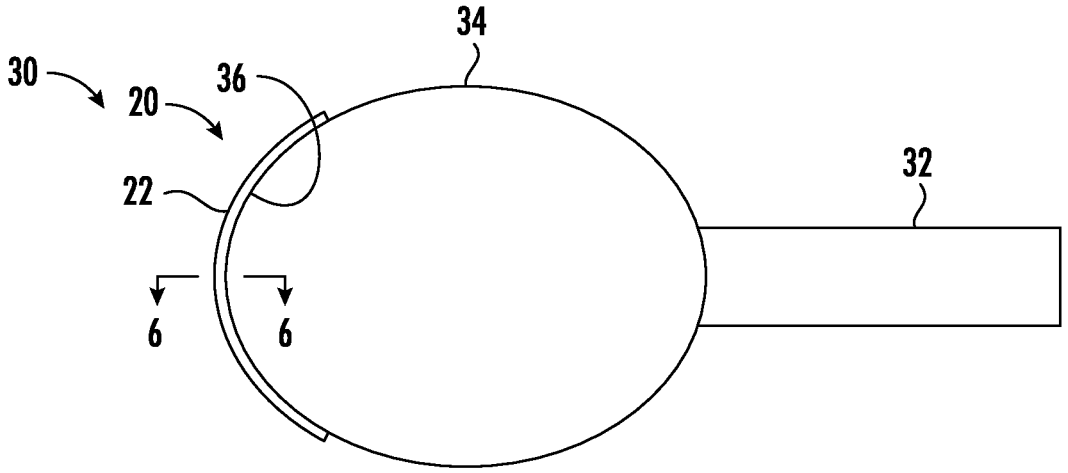
FIG. 5 is a top view of the example head guard of 1 applied to portions of an example head of an example paddle.
Figure 6:
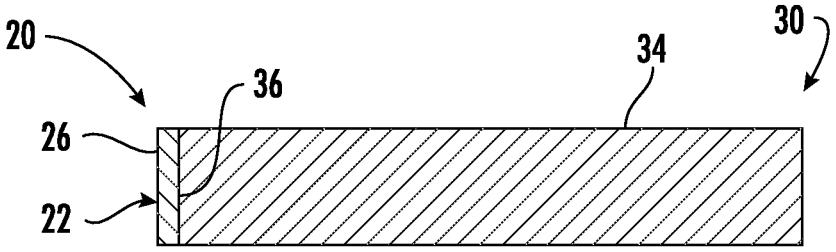
FIG. 6 is a sectional view of the example paddle and had guard of FIG. 5 taken along line 6-6.

As indicated by block 104, paddle head guard, such as guard 22, is removed from airtight package, such as package 24. As indicated by block 108, band 26, while in a flexible and moldable or bendable state, is wrapped about distal edge portions of a paddle head. FIGS. 5 and 6 illustrate guard 22 and band 26 being applied to an example paddle 30. Paddle 30 comprises a handle 32 and a head 34. As shown by FIG. 6, head 34 does not include strings and is not strung. Head 34 is generally imperforate and has an outer edge 36. Paddle 30 may be in the form of a paddle used for paddle tennis (Padel), platform tennis, pickle ball, table tennis or the like.

FIGS. 5 and 6 illustrate the band 26 of guard 22 after being wrapped about and against the outer edge of head 34 of paddle 30. Band 26 is illustrated as extending over those portions of head 34 directly opposite to handle 32 and those portions laterally extending to either side of the distal peripheral edge portion of head 34. In other implementations, band 26 may extend across additional peripheral edge portions of head 34. In the example illustrated, system 20 is illustrated as comprising a single guard 22 or band 26 protecting selected portions of head 34. In other implementations, system 20 may comprise multiple individual guards 22 or bands 26 which are placed end-to-end, or which are spaced from one another along selected peripheral edge portions of head 34.

As indicated by block 112 of FIG. 4, once the guard has been positioned against and about selected peripheral edge portions of head 34, band 26 is maintained against such selected peripheral edge portions as it completes its hardening. Band 26 hardens while the paddle head guard 22 is wrapped about the distal portion of the paddle head.

In some implementations, an adhesive or the like may be pre-applied to the outer peripheral edge 36 to assist in maintaining band 26, once hardened, against and along the outer peripheral edge 36. In some implementations, guard 22 or its band 26 may be shaped or configured session snap onto and be retained along the outer peripheral edge 36.

Figure 7:
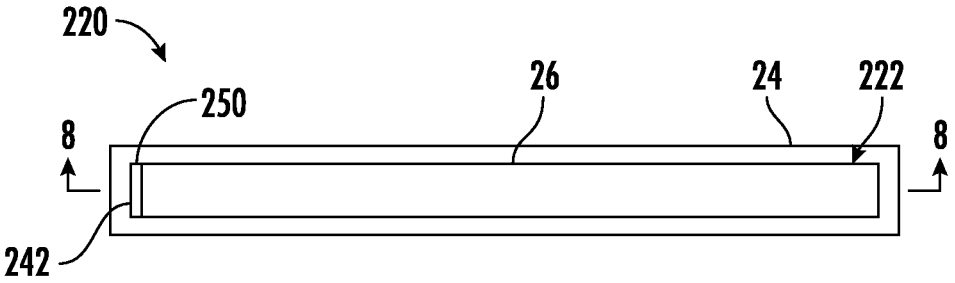
FIG. 7 is a top view of an example paddle head guard system illustrating an example head guard contained an example airtight package which is transparently shown for purposes of illustration.
Figure 8:
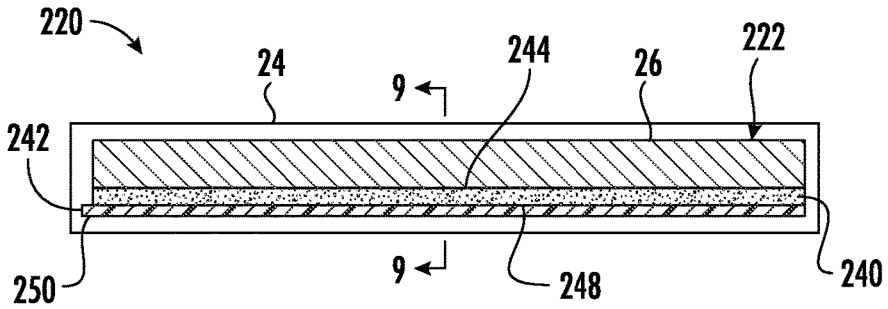
FIG. 8 is a sectional view of the system of FIG. 7 taken along line 8-8.
Figure 9:
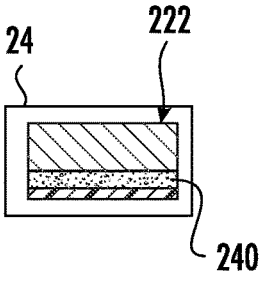
FIG. 9 is a sectional view of the system of FIG. 7 taken along line 9-9.

FIGS. 7-9 illustrate portions of an example paddle head guard system 220 in which guard 222 is similar guard 22, but additionally comprises adhesive layer 240 and peel away film 242. Those remaining components of paddle head guard system 220 which correspond to components of paddle head guard system 20 described above are numbered similarly.

Adhesive layer 240 comprises a thin layer of adhesive material coated, printed upon or otherwise applied to the inner face 244 of band 26. In some implementations, adhesive layer room 240 is supported on both sides of a thin film or substrate. Inner face 244 is a face of band 26 that is to face in a direction towards edge portion 36 when guard 222 is coupled to paddle 30. Adhesive layer 240 may be continuous or may be discontinuous, being applied to selected portions of face 244. In some implementations, adhesive layer 244 has a weight of no greater than 3 g. Examples of the composition of adhesive layer 242, include, are not limited to, vinyl or other adhesive materials.

Peel away film 242 comprises a film, foil or membrane secured to face 248 of the adhesive layer 240, with the adhesive layer 240 being sandwiched between film 242 and guard 222. Peel away film 242 covers the adhesive layer 240 to inhibit the adhesive layer 240 from coming into contact with package 24 while guard 222 is within package 24. Film 242 further facilitates easier handling of guard 222 once guard 22 has been removed from package 24 prior to the application of guard 222 to peripheral edge 36 of paddle 30. Peel away film 242 is configured to be manually peeled from or separated from surface 248 of adhesive layer 240 while adhesive layer 240 remains adhered to face 244 of band 26.

In the example illustrated, peel away film 242 comprises a tongue 250 projecting outwardly beyond adhesive layer 240 and band 26. Tongue 250 facilitates easier gripping of film 242 and separation of film 242 from adhesive layer 240 and band 26. In other implementations, tongue 250 may be omitted.

Figure 10:
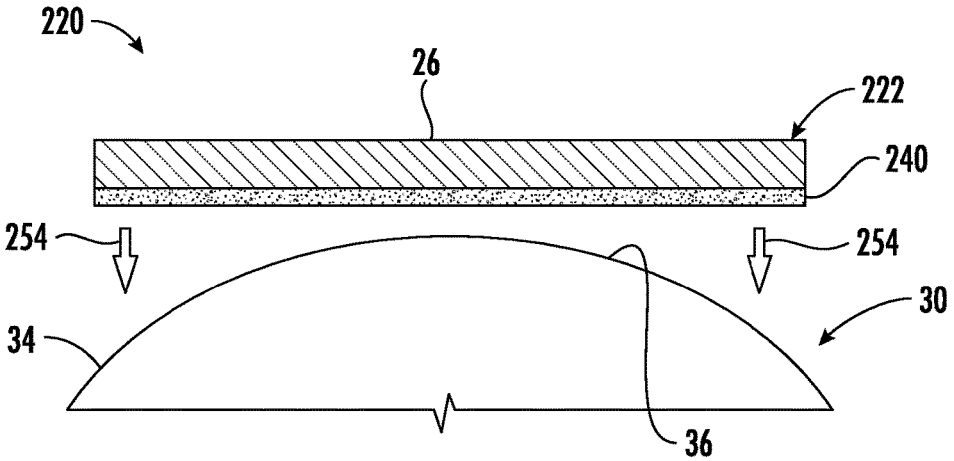
FIG. 10 is a sectional view illustrating the example head guard of 8 being applied to outer edge portions of an example head of an example paddle.
Figure 11:
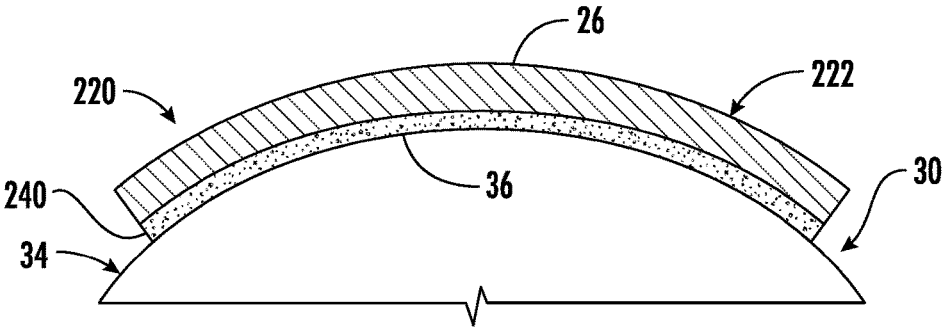
FIG. 11 is a sectional view of the example head guard applied to outer edge portions of the example head of the example paddle.

FIGS. 10 and 11 illustrate the application of guard 222 to distal edge portions 36 of head 34 of paddle 30. As shown by FIG. 9, band 26, along with the carried adhesive layer 240 and film 242 are removed from the airtight package 24. Thereafter, film 242 is peeled away from the adhesive layer 240, exposing the adhesive layer 240. Once this is done, guard 222 positioned opposite to the peripheral edge portion 36 of head 34 to which guard 222 is to be joined. As indicated by arrows 254, band 26 and adhesive layer 240 are moved towards edge portion 36. As shown may FIG. 11, band 26 and adhesive layer 240 are bent, deformed or wrapped about edge portion 36 of head 34 of paddle 30. This is accomplished while band 26 is in a moldable, flexible or shapeable state. With adhesive layer 240 and band 26 adhered to peripheral edge portion 36, band 26 undergoes or completes its hardening as a result of being exposed to air. As described above, in some implementations, the hardening process may take less than one hour of exposure to air. In some implementations, the hardening process may take less than 30 minutes. Once hardened, band 26 forms a rigid outer shell along the peripheral edge 36 for protecting the peripheral outer edge 36 from damage and where during play.

Figure 12:
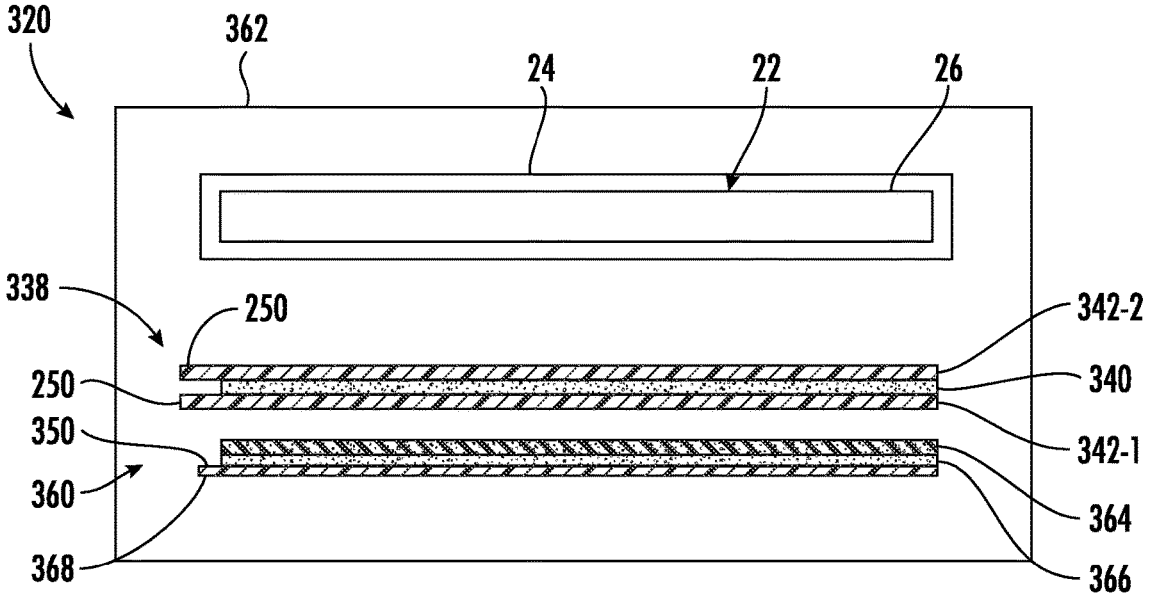
FIG. 12 is a diagram of an example head guard system, FIG. 12 including a top view example head guard sealed is in an airtight package and sectional views of an example bonding strip an example cushion strip.

FIG. 12 illustrates portions of an example paddle head guard system 320. FIG. 12 illustrates an example of how a paddle head guard system may be provided as a kit. Paddle head guard system 320 is similar to paddle head guard system 20 described above except that paddle head guard system 320 additionally comprises bonding strip 338, cushion strip 360 and outer package 362. Those remaining components of paddle head guard system 320 which correspond to components of paddle head guard system 20 are numbered similarly.

Bonding strip 338 comprises strip that is separate from package 24 and guard 22 and which is provided for user application to a paddle 30 prior to the securement of guard 22 to paddle 30 or for user application to guard 22 prior to the securement of guard 22 to paddle 30. Bonding strip 338 comprises adhesive layer 340 and peel away strips 342-1 and 342-2 (collectively referred to as strips 342). Adhesive layer 340 is similar to adhesive layer 240 described above except that adhesive layer 340 is sandwiched between peel away strips 342. Peel away strips 342 are temporarily adhered to offset sides of adhesive layer 340 and are configured to be manually peeled away from adhesive layer 340. In the example illustrated, each of peel away layers 342 has a similar, as peel away strip 242 described above.

Cushion strip 360 provides a person with the option of adding a soft, compressible cushion layer to guard 22. Cushion strip 360 comprises cushion layer 364, adhesive layer 366 and peel away film 368. Cushion layer 364 comprises a layer of a resiliently compressible material. In some implementations, cushion layer 364 comprises a rubber or elastomeric polymer. In some implementations, cushion layer 364 comprises a closed cell or open cell foam layer.

Adhesive layer 366 is coated, printed or otherwise adhered to the face of cushion layer 364. In some implementations, adhesive layer 366 may be supported upon both sides of a thin film or substrate. Adhesive layer 366 is configured to adhere cushion layer 364 to a face of guard 22. In some implementations, adhesive layer 366 bonds cushion layer 364 to guard 22 prior to guard 22 being adhered to outer edge 36 of head 34 of paddle 30. In some implementations, adhesive layer 336 may bonded cushion layer 364 to guard 22 after guard 22 has been bonded to outer edge 36 of head 34 of paddle 30, prior to or after hardening. In some implementations, adhesive layer 366 and the same formulation or composition as adhesive layer 240 described above.

Peel away film 368 is similar to peel away films 342. Peel away film 368 covers adhesive layer 366 until cushion strip 360 is ready for application. As with peel away film 342, peel away from 368 includes a tongue portion 352 facilitate separation of film 368 from adhesive layer 366. In some implementations, cushion layer 360 may be applied to an outer surface of guard 22 prior to guard 22 being packaged within package 362. In some implementations, cushion layer 360 may be applied to an outer surface of guard 22 prior to guard 22 being sealed within package 24. In such implementations where cushion layer 360 is applied to guard 22 at such a point of manufacture, peel away film 368 may be omitted. In some implementations, the kit including guard 22 and bonding strip 368 may omit cushion strip 360.

Figure 13:
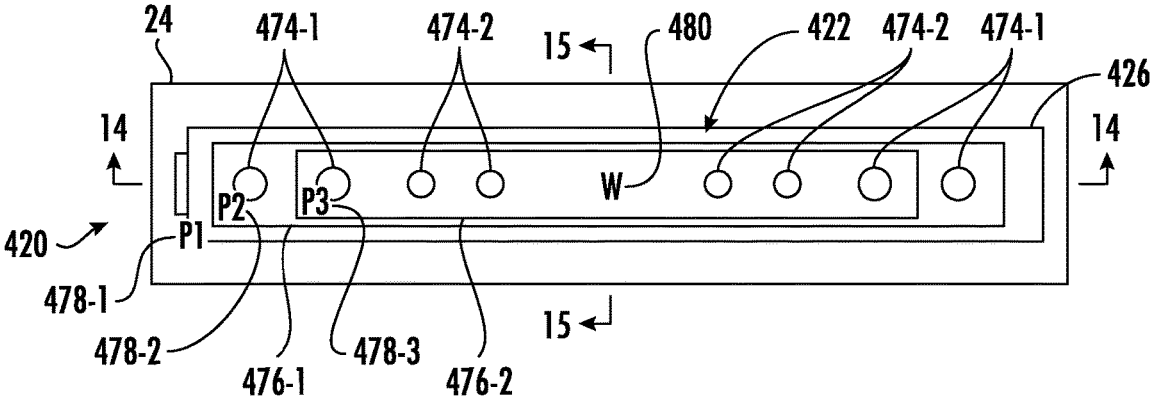
FIG. 13 is a top view of an example paddle head guard system illustrating an example head guard contained an example airtight package which is transparently shown for purposes of illustration.
Figure 14:
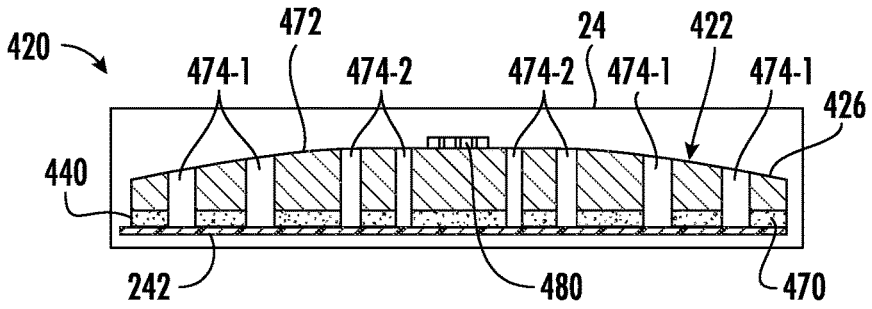
FIG. 14 is a sectional view of the system of FIG. 13 taken along line 8-8.
Figure 15:
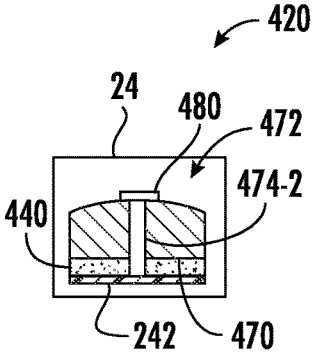
FIG. 15 is a sectional view of the system of FIG. 13 taken along line 9-9.

FIGS. 13-15 illustrate portions of an example paddle head guard system 420. FIGS. 13-15 illustrate an example of how the paddle head guard may comprise a moldable and hardenable band that may (1) include perforations; (2) have a nonuniform thickness along its length and/or width; (3) may have a nonuniform density or weight distribution along the length and/or width; (4) may have a three-dimensional top surface, potentially including designs, graphics, insignias, logos or the like; include cut lines and indicators to permit a single guard to be useless multiple differently sized paddle heads. Those components of paddle head guard system 420 which correspond to components of the above-described paddle head guard systems are numbered similarly and/or are described above. Paddle head guard system 420 comprises guard 422 sealed within an airtight package 24 (described above). Guard 422 comprises moldable and hardenable band 426, adhesive layer 440 and peel away film 242 (described above).

Band 426 comprises flexible, moldable, shapeable layer of hardenable material configured to be bent, deformed, wrapped or otherwise shaped about a paddle head, directly or indirectly against exterior edge portions of the paddle head. Band 426 may be formed from the same composition as that of band 26 described above. In some implementations, the band hardens to a hardness of at least 70 on a Shore A scale. In one implementation, the band can have a weight of less than 20 grams, a width of 50 mm or less, a maximum thickness of 4 mm or less (no greater than 2 mm in some implementations), and a length of 400 mm or less. In another implementation, the band can have a weight of no greater than 13 g, a width of no greater than 45 mm, a thickness of 3 mm or less, and/or a length of no greater than 350 mm.

In some implementations, band 426 may be formed from a material that hardens in response to sufficient exposure to air which may be at the same temperature as band 426 prior to and during such exposure. In such implementations, band 426 may be maintained in the moldable state by being sealed within and airtight package or container. In some implementations, band 426 may be formed from a material that softens to a moldable state upon application of heat such that band 426 attains an elevated temperature of at least 150° F. and subsequent hardening upon being allowed to cool to room temperature (68 to 72° F., 20-22° C.) or the ambient temperature of the surrounding environment. For example, in some implementations, band 426 may be heated to an elevated temperature by being placed within boiling water or by being microwaved in a microwave oven until band 426 has attained an elevated temperature greater than at least 150° F., wherein the band may be simply wrapped about or against a paddle head and allowed to cool to a hardened state. In such implementations where band 426 hardens in response to cooling, rather than mere exposure to air, airtight package 24 need not be airtight or may be omitted. Band 426 comprises inner surface 470, outer surface 472, perforations 474-1, 474-2 (collectively referred to as perforations 474), cut lines 476-1, 476-2 (collectively referred to as cut lines 476) and paddle indicators 478, 478-2 and 478-3.

Inner surface 470 comprise the face of band 426 that is to face in a direction towards outer edge portion 36 of the head 34 of the paddle 30. In the example illustrated, inner surface 470 has a profile matching the surface profile of the outer edge portion 36. In the example illustrated, inner surface 470 has a generally smooth or flat profile corresponding to the smooth or flat, but rounded profile of the outer edge portion 36. In some implementations where the outer edge portion 36 has a circumferential groove, inner surface 470 may have a corresponding projection, rib or tongue configured to be received within the circumferential groove. In other implementations, the inner surface has a smoother flat profile, spanning across the circumferential groove of the outer edge portion 36.

Outer surface 472 faces in a direction away from inner surface 472, away from head 34 when guard 22 is mounted to head 34. As shown by FIG. 14, outer surface 472 is shaped or rounded such that band 426 has a non-uniform thickness along its length, having a greatest thickness at a midpoint and having a reduced thickness at opposite longitudinal ends. In other implementations, band 426 may have a greater thickness at opposite longitudinal ends and a lesser/reduced thickness at its midpoint. In some implementations, band 426 may have a wavy or sinusoidally varying thickness along its length.

As shown by FIG. 15, outer surface 472 is shaped or rounded such that band 426 has a nonuniform thickness along its width, having a greater thickness at a transverse midpoint and having a reduced thickness on the opposite transverse ends. The non-uniform thickness of band 426 along its length and/or width provides band 426 with a non-uniform density or weight distribution along its length and/or width. In such a manner, the weight distribution of band 426 may be customized to user preferences or to provide enhanced performance of paddle 30 when equipped with guard 422. In some implementations, band 426 may alternatively be shaped so as to have a uniform thickness and a uniform weight distribution along its length and/or width. In some implementations, rather the being curved or rounded, outer surface 472 may have other non-uniform shapes along its length and/or width.

In the example illustrated, surface 472 is three-dimensional, being non-smooth and having projections and depressions along the length and size or width of surface 472. In the example illustrated, surface 472 comprises raised portions or projections that form a design or logo 480 in the shape of a "W". In other implementations, surface 472 may be three-dimensional in that is shaped to form other raised or depressed designs. In other implementations, surface 472 may be smooth or flat, but rounded, without a three-dimensional surface.

Perforations 474 comprise passages or openings that extend through band 426. Perforations 474 may reduce the weight of band 426 in certain portions along band 426. Perforations 474 may additionally reduce the amount of time needed for band 426 to change from a moldable state to the hardened state. In those implementations where band 426 hardens in response to exposure to air (regardless of its temperature), perforations 474 may increase the total surface area of band 426 exposed to air to increase the rate of hardening of band 426. In those implementations where band 426 hardens in response to cooling from an elevated temperature resulting from the application of heat, perforations 474 may increase the rate at which band 426 cools, thereby increasing the rate at which band 426 hardens once shaped or molded against the outer edge portion of the paddle head.

In the example illustrated, perforations 474 extend completely through band 426, from surface 472 to surface 470. In other implementations, perforations 474 may partially extend through the thickness of band 426. Although illustrated as being generally cylindrical in shape, in other implementations, perforations 474 may have other cross-sectional shapes. Although illustrated as having a uniform diameter, width or shape along an axis extending from surface 472 to surface 470, in other implementations, the cross-sectional shape or the dimensions of the perforation may vary as the perforation 474 extends from surface 472 to surface 470. In the example illustrated, perforations 474-1 are larger than perforations 474-2, further providing a non-uniform density or weight distribution along the length and width of band 426. In some implementations, some or all of perforations 474 may be omitted.

Adhesive layer 440 is similar to adhesive layer 240 described above. Adhesive layer 440 is configured to adhere surface 470 of band 426 to outer edge portions 36 of head 34 of paddle 30. In some implementations, adhesive layer 440 may comprise an adhesive material coated or otherwise deposited upon both sides of a supporting film or substrate. In the example illustrated, adhesive layer 440 includes perforations corresponding to different sized, shaped and located in alignment with) each of perforations 474. As result, the exterior surface of outer edge portions 36 are exposed through perforations 474. In other implementations, adhesive layer 440 may continually extend across span across the bottoms of such perforations 474.

Although the example guard 422 is illustrated as comprising band 426 which supports adhesive layer 440 and peel away film 242, in other implementations, band 426 may omit adhesive layer 440 and peel away film 242, such as when band 426 is utilizing a kit similar to system described above, wherein band 426 is contained in airtight package 24 and wherein the kit further includes the bonding strip 338 and may optionally include the cushion strip 360. In such implementations, the cushion strip 360 and size or the bonding strip 338 may or may not include perforations corresponding to the perforations 474 and band 426. As noted above, in some implementations, perforations 474 may be omitted.

Figure 16:
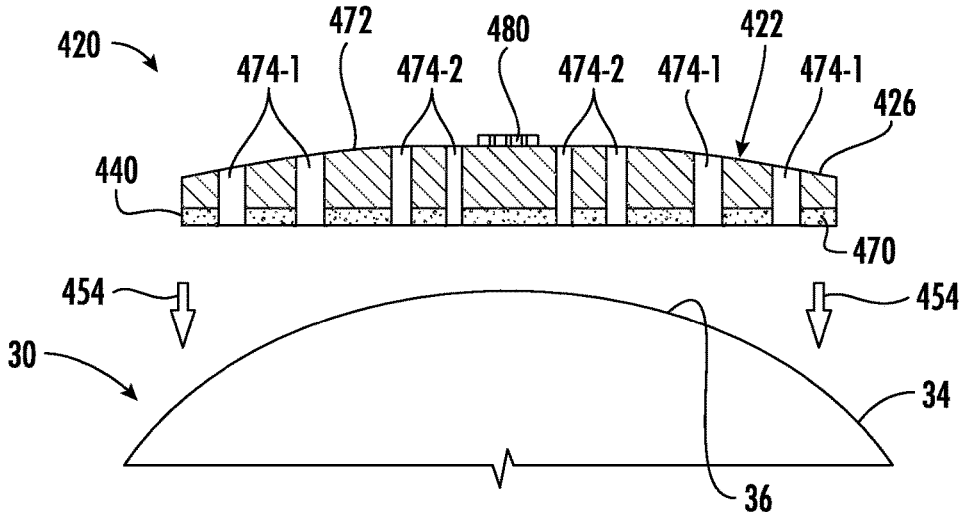
FIG. 16 is a sectional view illustrating the example head guard of 14 being applied to outer edge portions of an example head of an example paddle.
Figure 17:
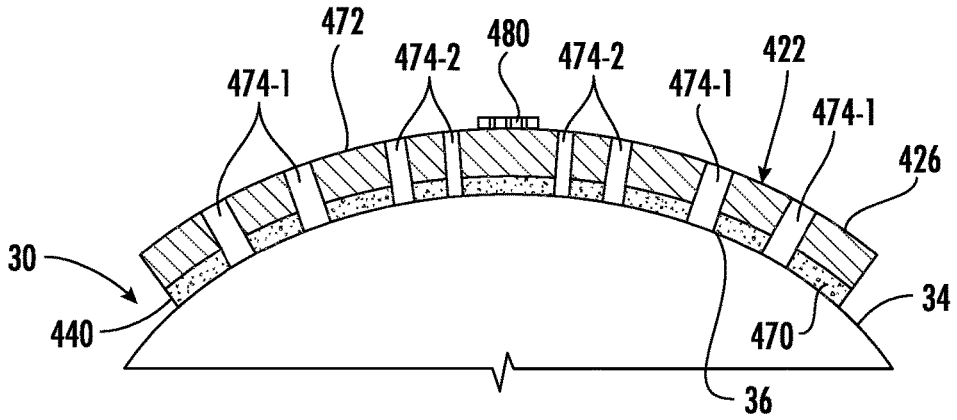
FIG. 17 is a sectional view of the example head guard applied to outer edge portions of the example head of the example paddle.

FIGS. 16 and 17 illustrate the application of paddle head guard system 420 to distal edge portions 36 of head 34 of paddle 30. As shown by FIG. 16, guard 422 is removed from the airtight package 24. Thereafter, film 242 is peeled away from the adhesive layer 440, exposing the adhesive layer 440. Once this is done, guard 422 is positioned opposite to the peripheral edge portion 36 of head 34. As indicated by arrows 454, guard 422 is moved towards edge portion 36. As shown may FIG. 16, guard 422 is bent, deformed or wrapped about edge portion 36 of head 34 of paddle 30. This is accomplished while band 426 is in a moldable, flexible or shapeable state. With adhesive layer 440 adhering band 426 to peripheral edge portion 36, band 426 undergoes or completes its hardening as a result of being exposed to air. As described above, in some implementations, the hardening process may take less than one hour of exposure to air. In some implementations, the hardening process may take less than 30 minutes. Once hardened, band 426 forms a rigid outer shell along the peripheral edge 36 for protecting the peripheral outer edge 36 from damage and where during play.

Figure 18:
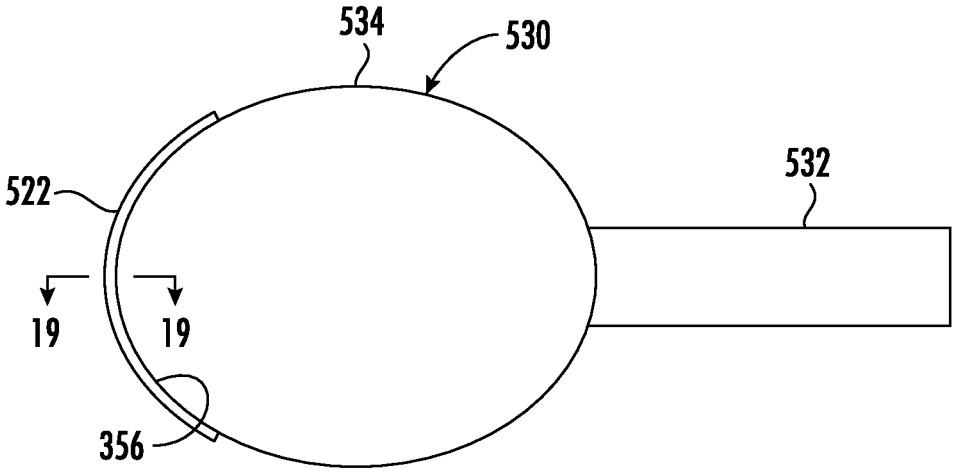
FIG. 18 is a top view of an example paddle with a mounted head guard.
Figure 19:
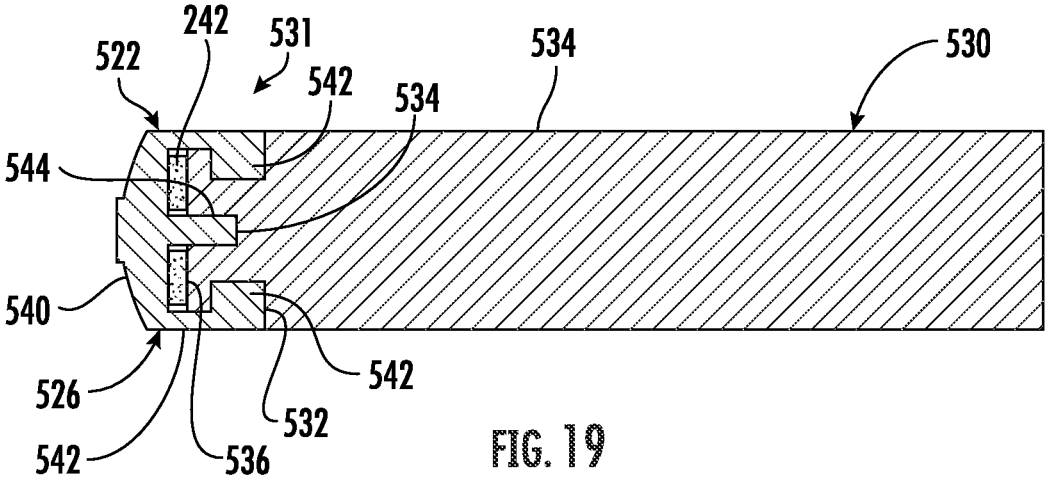
FIG. 19 is a sectional view of the example paddle and had guard of FIG. 18 taken along line 19-19.

FIG. 18 illustrates portions of an example paddle head guard 522 secured to an example paddle 530 having a handle 532 and a head 534. FIG. 19 is an enlarged sectional view illustrating portions of the example paddle 530 with the mounted paddle head guard 522. As shown by FIG. 19, head 534 of paddle 530 comprises a rim portion 531 having an annular side recessed groove 532 and axial groove 534 that extends along the outer circumferential perimeter of head 534. Head 534 further comprises an outer edge portion 536 which extends about the whole perimeter of head 534.

As shown by FIG. 19, head guard 522 is similar to head guard 422 described above except that head guard 522 comprising band 526 which includes edge cover 540, sleeve portion 542, post 544 and an annular inwardly projecting ring 546. Edge cover 540 is dimensioned and configured to extend along the outer peripheral edge portion 536 of head 534. Sleeve portion 542 extends from edge cover 540 extends along a side of head 534. Post 544 projects from edge cover 540 in the size and located so as to project into axial groove 534. Ring 546 projects inwardly from sleeve portion 542 and is configured to be received within groove 532 of head 534.

Head guard 522 is formed from a material similar to that of band 426. Head guard 52 is formed from a moldable and hardenable material supplied in an airtight package to inhibit hardening or activation. Head guard 522 is positioned along and about outer edge 536 of head 534 with post 544 positioned within groove 534 and with ring 542 received within groove 532. In some implementations, head guard 522 additionally comprises adhesive layer 240 adhering edge cover 540 to edge portion 536. With post 544 received within groove 534 and with ring 542 received within groove 532, head guard 522 is exposed to air and permitted to harden, locking head guard 522 along the perimeter of head 534. The hardened head guard 522 provides the thin, but durable protective covering along the perimeter of head 534.

In the example illustrated, the molding and subsequent hardening of the moldable and hardenable head guard 522 about the distal edge of the paddle 530 results in the guard locking to and against the distal edge of the paddle head 534. Portions of head guard 522 are wrapped about wider portions of the edge and bent inwardly prior to hardening of the guard 522, wherein the opposite side edges of the layer are separated by a distance that is less than the wider width portions of the edge portion of head 534.

Although the present disclosure has been described with reference to example implementations, workers skilled in the art will recognize that changes may be made in form and detail without departing from the scope of the claimed subject matter. For example, although different example implementations may have been described as including features providing benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. A paddle head guard system comprising:

a paddle head guard sized to at least partially cover an outer edge portion of a paddle head, the guard comprising a moldable and hardenable band configured to be hardened after being wrapped over the outer edge portion of the paddle head; and an airtight package containing and sealed about the paddle head guard to maintain the moldable and hardenable band in a non-hardened state prior to being removed from the airtight package and being applied to the paddle head, wherein the paddle head guard has a chemical composition configured to automatically undergo a chemical reaction and initiate hardening to a hardness value of at least 70 on a Shore A scale solely due to exposure to air in response to removal from the airtight package.

2. The paddle head guard system of claim 1, wherein the paddle head guard further comprises an adhesive layer supported by the moldable and hardenable band, the adhesive layer being configured to bond the guard to the outer edge portion of the paddle head.

3. The paddle head guard system of claim 2, wherein the adhesive layer and the moldable and hardenable band have a combined thickness of no greater than 1.5 mm.

4. The paddle head guard system of claim 2, wherein the paddle head guard further comprises a film manually peelable from the adhesive layer to expose adhesive layer.

5. The paddle head guard system of claim 1 further comprising a bonding strip comprising:

an adhesive layer having a first face for bonding to the moldable and hardenable band and a second face for bonding to the outer edge portion of the paddle head;

a first film adhered to and manually peelable from the first face of the adhesive layer; and a second film adhered to and manually peelable from the second face of the adhesive layer.

6. The paddle head guard system of claim 1, wherein the paddle head guard has a thickness of no greater than 2.0 mm.

7. The paddle head guard system of claim 1, wherein the paddle head guard has a weight of no greater than 13 g.

8. The paddle head guard system of claim 1, wherein the moldable and hardenable band is:

flat;

has a weight of no greater than 13 g;

has a width of no greater than 45 mm; and has a length of no greater than 350 mm.

9. The paddle head guard system of claim 1, wherein the moldable and hardenable band is imperforate.

10. The paddle head guard system of claim 1, wherein the moldable and hardenable band is perforate.

11. A method comprising:

removing a paddle head guard from an airtight package to automatically initiate a chemical reaction to initiate hardening of the paddle head guard to a hardness value of at least 70 on a Shore A scale solely due to exposure to air in response to removal from the airtight package;

bending and wrapping the paddle head guard about an edge portion of a paddle head prior to hardening of the paddle head guard to the at least 70 on the Shore A scale;

hardening the paddle head guard to the at least 70 on the Shore A scale while the paddle head guard is wrapped about the edge portion of the paddle head.

12. A paddle comprising:

a handle;

a head having an outer peripheral edge;

a paddle head guard system secured to the outer peripheral edge, the paddle head guard system comprising:

an elongate guard at least partially covering the outer peripheral edge of the head, the guard formed from a material configured to harden to a hardness value of at least 70 on a Shore A scale solely in response to being removed from an airtight package and when exposed to ambient room temperature air after being wrapped over the outer peripheral edge, wherein the guard a thickness of no greater than 2.0 mm.

13. The paddle of claim 1, wherein the thickness of the band is less than one quarter of the width of the band.

14. The method of claim 11 further comprising wrapping opposite side edges of the guard inwardly along opposite faces of the head.

15. The paddle of claim 12, wherein the elongate guard has a longitudinal length and an outer surface tapering in opposite longitudinal directions along a majority of the longitudinal length such that the band has a greatest thickness at a longitudinal midpoint and has a reduced thickness at opposite longitudinal ends of the longitudinal length.

16. The paddle of claim 12, wherein the band has a rectangular cross-section, a thickness of the band being less than half of a width of the band.

17. The paddle head guard system of claim 1, wherein the band has a longitudinal length and an outer longitudinal tapering surface tapering in opposite longitudinal directions along a majority of the longitudinal length such that the band has a greatest thickness at a longitudinal midpoint and has a reduced thickness at opposite longitudinal ends of the longitudinal length.

18. The paddle head guard system of claim 17, wherein the band has a transverse width and an outer transverse tapering surface tapering in opposite transverse directions along a majority of the transverse width such that the band has a greatest thickness at a transverse midpoint and has a reduced thickness at opposite transverse edges of the transverse width.

19. The paddle head guard system of claim 17 further comprising perforations extending through the outer longitudinal tapering surface.

20. The paddle head guard system of claim 1, wherein the band has a transverse width and an outer surface tapering in opposite transverse directions along a majority of the transverse width such that the band has a greatest thickness at a transverse midpoint and has a reduced thickness at opposite transverse edges of the transverse width.

21. The paddle head guard system of claim 1, wherein the band comprises a series of perforations transversely centered along its length, wherein particular perforations of the series of perforations near a midpoint are smaller than particular perforations at opposite longitudinal ends of the band.

* * * * *